United States Patent [19]

Sionnet et al.

[11] Patent Number: 4,944,559

[45] Date of Patent: Jul. 31, 1990

[54] TOOL FOR A MINE WORKING MACHINE COMPRISING A DIAMOND-CHARGED ABRASIVE COMPONENT

[75] Inventors: Jean Sionnet, Saint Egreve; Paul A. Renard, Uriage, both of France

[73] Assignee: Societe Industrielle de Combustible Nucleaire, Annecy, France

[21] Appl. No.: 360,175

[22] Filed: Jun. 1, 1989

[30] Foreign Application Priority Data

Jun. 2, 1988 [FR] France ..... 88 07371

[51] Int. Cl.[5] ..... E21C 35/18

[52] U.S. Cl. ..... 299/86; 299/79; 175/410

[58] Field of Search ..... 299/79, 86; 175/329, 175/410; 76/108 A

[56] References Cited

U.S. PATENT DOCUMENTS 4,610,316 9/1986 Boaz ..... 175/323

4,725,098 2/1988 Beach ..... 299/79

FOREIGN PATENT DOCUMENTS 1203714 7/1964 Fed. Rep. of Germany ..... 299/79

1102936 7/1984 U.S.S.R. ..... 299/79

*Primary Examiner*—William P. Neuder

*Attorney, Agent, or Firm*—Sughrue, Mion, Zinn, Macpeak & Seas

[57] ABSTRACT

The body (1) of the tool consists of a single-piece steel component. The housing (3) for the composite abrasive component (2) is provided in this steel component. The working surface (5) of the body (1) has, at least in its component-holder part (*5a*), and angle at the lower vertex of at least 20% with respect to the angle at the vertex of the corresponding part (*8a*) of a metallic carbide tool for working the same rock. The surface (*5a*) of the component holder (4) is at least partially covered by an erosion layer (10) of hard material.

15 Claims, 2 Drawing Sheets

TOOL FOR A MINE WORKING MACHINE COMPRISING A DIAMOND-CHARGED ABRASIVE COMPONENT

FIELD OF THE INVENTION

The invention relates to a tool for a mine working machine comprising a diamond-charged abrasive component.

BACKGROUND OF THE INVENTION

The tools used for working rocks in the field of mine working generally consist of a body in treated steel, the rear part of which constitutes a holder permitting the mounting of the tool in a support of a working machine and the front part of which carries a point of a hard material, such as tungsten carbide. The assembly of the tool is symmetrical in revolution and the holder is mounted in the tool support so that the tool may rotate about its axis during the operation of working the rock.

In order to increase the lifespan of the tool, it has been proposed to use, for constituting the point of the tool, a material which is more resistant to abrasion than tungsten carbide. For example, a tool has been proposed in Patent GB-A-2,146,058 which comprises an active part in a material which is resistant to abrasion, such as polycrystal diamond. To this end, a housing is provided in the end of the working part of the tool, made of tungsten carbide, and a composite abrasive component having an active end part made of polycrystal diamond is fixed inside the housing.

The front part of the tool constitutes a working surface with an overall frustoconical shape, having a component-holder part at its end with respect to which the active part of the composite abrasive component, made of polycrystal diamond, projects.

The advantage of this tool over tools comprising a tungsten carbide point is, however, limited. In fact, the diamond is approximately ten times as expensive as tungsten carbide and it would be necessary, for the price of the tool to remain competitive, for the lifespan of this diamond-charged tool to be increased to the same extent or to a similar extent.

In fact, it has been possible to observe that, in reality, the lifespan of such a tool comprising a diamond-charged abrasive component was considerably reduced because of the poor mechanical strength of the tungsten carbide in the component-holder part of the tool.

In fact, the presence of the housing in the component-holder part of frustoconical shape means that there is consequently an annular zone of small thickness made of tungsten carbide around the abrasive component.

As the tungsten carbide has poor bending and shear strength, cracks appear, during operation of the tool, in the component-holder part, constituting a weakened zone. The composite abrasive component can then be ejected from its housing after a relatively short time of use of the tool, which limits the overall lifespan of the tool and involves an increase in the operating coats of the working machine.

Depending on the nature of the rock being worked, an angle is provided at the vertex of the working frustoconical part of the tool and, in particular, of the component-holder part which is adapted to the specific working conditions of the rock.

It is evident that the annular zone surrounding the composite abrasive component has a thickness which is greater, the greater the actual angle of the frustum of the cone of the component-holder part. An increase in this angle substantially in excess of the angle corresponding to the erosion profile of the working part of the tool leads, however, to an accelerated erosion of this working zone and of the component-holder part.

SUMMARY OF THE INVENTION

The aim of the invention is therefore to propose a tool for a mine working machine consisting of a body carrying a projecting composite abrasive component at its front working end, the body comprising, at the rear, a holder enabling it to be mounted in a tool support for the working machine and, at the front, a working surface of overall frustoconical shape having a component-holder part whose angle at the vertex $\alpha$ depends on the nature of the rock being worked and the composite abrasive component fixed in a housing arranged inside the component-holder part of the working surface of the body consisting of a metallic carbide slug which is integrally attached at its end projecting with respect to the body to a polycrystal diamond active part, this tool making it possible to avoid, during operation, and to a large extent, cracking of the body in the vicinity of the composite abrasive component, excessive erosion of the working surface of the body and considerable friction.

To this end:

the body of the tool consists of a single-piece steel component, the housing of the composite abrasive component being provided in this steel component, the working surface of the body has, at least in its component-holder part, an angle at the vertex $\alpha'$ which is at least 20% smaller than the angle at the vertex of the corresponding part of a metallic carbide tool for working the same rock, and the surface of the component holder is covered, at least partially and at least immediately in the vicinity of the composite abrasive component, with an erosion layer in a material whose hardness is greater than that of the steel forming the body.

In order that the invention may be better understood, a description will now be given by way of non-limiting examples, with reference to the figures attached as an appendix, of several embodiments of a tool according to the invention which may be used for working coal or for working potash.

DETAILED DESCRIPTION OF THE PREFERRED EMBODIMENTS

Figure 1:
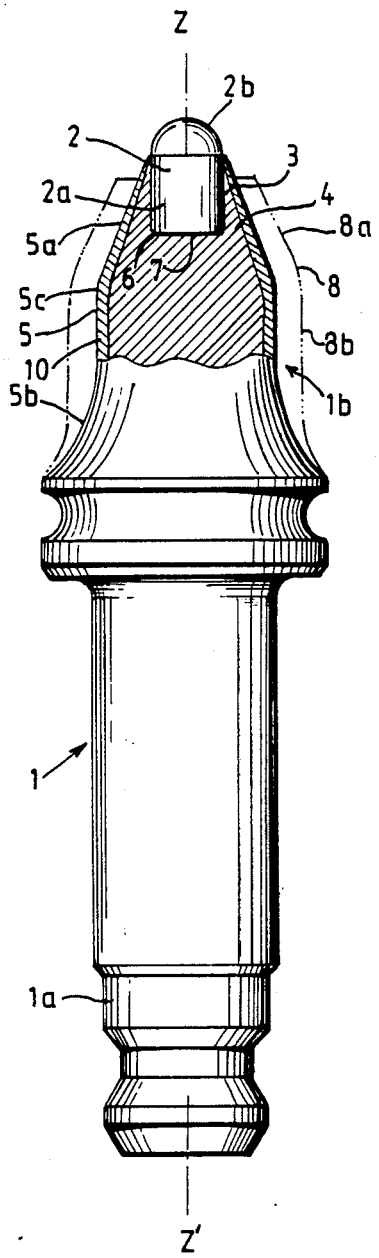
FIG. 1 is a view in elevation with partial section of a tool according to the invention for working coal.

FIG. 1 shows a tool for working coal which comprises a body 1 made of steel and a diamond-charged abrasive component 2.

The body 1 comprises a rear part 1*a* of overall cylindrical shape constituting the holder for the tool and a front part 1*b* of profiled shape constituting the working part of the tool.

The tool 1 is intended for a machine for working coal and the holder 1*a* has a shape enabling it to be fitted into a tool support of the working machine such that the tool, which is entirely symmetrical in revolution with respect to an axis ZZ', is mounted so as to rotate on the tool support about this axis.

The body 1 of the tool is produced in the form of a single-piece steel component having good mechanical characteristics and, in particular, good resilience and considerable bending, shear and fatigue strength.

This component may consist, for example, of a type 35CD4, 42CD4 or 35NCD16 steel which is heat treated so as to obtain a tensile strength which is at least equal to 90 hbar.

The housing 3 of the composite abrasive component 2 of cylindrical shape and with an axis ZZ' is machined at the end of the part 1*b* of the body 1 inside a zone 4 delimited by a frustoconical surface which hereinafter will be referred to as the component-holder part of the tool.

The frustoconical surface 5*a* surrounding the component-holder part 4 forms the front zone of the working surface 5 of the tool which comes into contact with the rock being worked.

The composite abrasive component 2 consists, in a known manner, of a cylindrical slug 2*a* made of tungsten carbide, which is integrally attached, at its end which projects with respect to the housing 3 of the component holder 4, to an active part 2*b* of hemispherical shape made of polycrystal diamond.

In a known manner, the forming of the composite abrasive component and the fixing of the active diamond part on the tungsten carbide slug are effected at high temperature and under very high pressure, a metal such as cobalt being used as binder.

According to the invention, the body 1 of the tool consists of a single-piece steel component in which the housing 3 for the composite abrasive component 2 is machined. The annular zone of the component holder 4 of small thickness included between the frustoconical surface 5*a* and the cylindrical housing 3 therefore consists of treated steel with a high mechanical strength and which is much less brittle than tungsten carbide. This avoids cracking of this part of the component holder when the tool is in use. Moreover, the favourable mechanical properties of the body of the tool enable it to transmit the forces of the working machine in an adequate manner.

The composite abrasive component 2 is fixed by brasing or grip fitting inside the housing 3, the brazed surface corresponding substantially to the entire surface of the housing 3. This technique for brazing a tungsten carbide component in a steel body is used, in the case of tools according to the prior art, to fix the tungsten carbide point into the body of the tool.

In order to limit the concentration of stresses in the bottom of the hole, provision may be made for the shape of the housing 3 to be adapted. Advantageously, the edges at the bottom of the hole will have a rounded part 6 and the bottom 7 will have a slightly conical or hemispherical shape.

FIG. 1 shows, in dotted lines, the contour 8 of the outer surface of the front working part 1*b* of the tool according to the prior art intended for a machine for working coal and comprising a steel body to which is attached a tungsten carbide tip. In a tool of this kind, according to the prior art, the housing for the diamond-charged abrasive component is machined at the end of the attached tungsten carbide component inside the frusto-conical surface 8*a* delimiting the component holder and constituting, with the substantially cylindrical surface 8*b*, the working surface of the tool.

In the case of a tool according to the prior art, for a machine for working coal, the angle of the vertex of the frustoconical surface 8*a* delimiting the component holder is of the order of 55°.

By comparison, the angle at the vertex of the surface 5*a* delimiting the component-holder part of the body of the steel tool according to the invention is 40°, which represents a reduction of slightly less than 30%.

The profile of the working surface of the tool according to the invention shown in solid lines in FIG. 1 is generally substantially more tapered than the profile of the working surface of the tool according to the prior art shown in dotted lines.

In this way, the mean diameter of the overall cylindrical part 5*b* arranged in the extension of the frustoconical part 5*a* of the working surface is 25% smaller than the corresponding diameter of the cylindrical part 8*b* of the working surface of the tool according to the prior art. The parts 5*a* and 5*b* of the working surface are connected by a rounded part 5*c* of substantially toric shape.

The profile of the tool according to the invention shown in solid lines corresponds substantially to the erosion profile of a tool of a machine for working coal, that is to say the equilibrium profile for which the friction and the erosion of the tool are lowest.

This profile may be used without causing the appearance of a brittle annular zone which is liable to crack in the region of the component holder. This result is obtained by virtue of the excellent mechanical properties of the treated steel constituting the body of the tool compared with the corresponding properties of an attached tungsten carbide component.

Although the use of a profile which is as close as possible to the equilibrium profile for the working part of the tool makes it possible to limit friction and erosion, it is nevertheless necessary to protect the outer working surface of the part 1*b* of the body of the tool, at least in the zone corresponding to the surface 5*a* of the compenent holder 4.

To this end, the surface 5*a*, the surface 5*c* and the front part of the surface 5*b* are covered with a layer of tungsten carbide 10 whose thickness is between 0.7 mm (zone located near the composite abrasive component 2) and 2 mm (front zone of the surface 5*b*).

This layer may be obtained by building up with a torch, using tungsten carbide embedded in a metallic binder such as nickel.

This layer may also be obtained, advantageously, by infiltration of a binder consisting of a liquid nickel-based alloy into the gaps in a layer of tungsten carbide particles moulded onto the surface to be coated.

It has been possible to show that a tool according to the invention comprising a single-piece steel body, with a more tapered shape than a conventional tool and a protective layer of a hard material on its working surface, had a lifespan during operation at least ten times greater than that of a tool according to the prior art. The use of a diamond-charged abrasive component is therefore prefectly justified.

Figure 2:
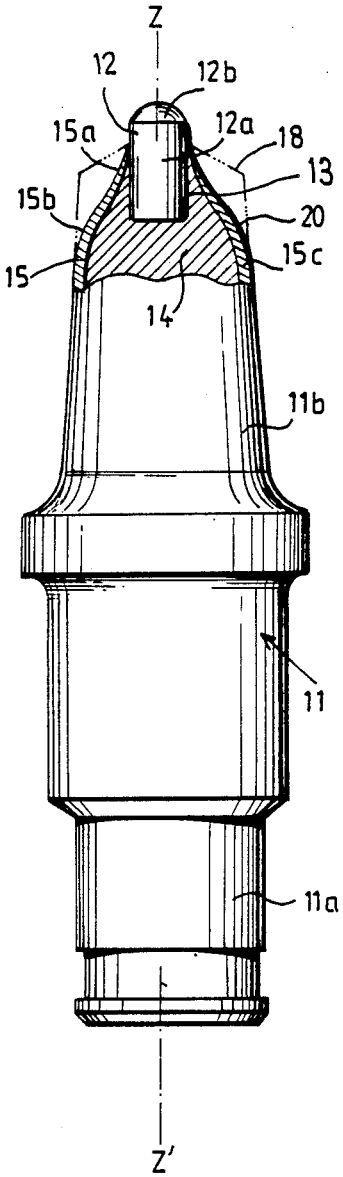
FIG. 2 is a view in elevation with partial section of a tool according to the invention for working potash.

FIG. 2 shows a tool for a mining machine for working potash comprising a single-piece steel body 11 of the same type as the body 1 of the tool shown in FIG. 1. The body 11 comprises at the rear a holder 11*a* and at the front a working part 11*b* delimited by successive frustoconical surfaces according to the axial direction. The front end of the working part 11*b* of the tool constitutes the component holder 14 delimited by a frustoconical surface 15*a* which is itself connected to the surface of the base of the part 11*b* of the tool via a second frustoconical surface 15*b* and via a toric surface 15*c*.

The composite abrasive component 12 comprising a cylindrical tungsten carbide slug 12*a* and a hemispherical active end part 12*b* in polycrystal diamond is fixed as previously by means of brazing inside a housing 13 machined in the steel body of the tool in the component-holder part 11.

FIG. 2 also shows in dotted lines the contour 18 of the tungsten carbide and component fitted in the steel body of a tool according to the prior art. The angle at the vertex of the end frustoconical part of the contour 18 is, in the case of potash, approximately 80°.

By comparison, the angle at the vertex of the part 15*a* of the outer surface of the component holder 14 of the tool according to the invention is 55° in the vicinity of the composite abrasive component 12, which represents a reduction of slightly more than 30%.

The angle of the part 15*b* is of the order of 70°, which is also smaller than the angle of the usual profile of a tool for working potash.

The tool according to the invention is generally more tapered, in its front end part, than the tool comprising an attached tungsten carbide component according to the prior art.

As in the case of the tool for working coal which has been described above, the working surface 15 of the body 11 of the tool is covered, in its end part in the immediate vicinity of the composite abrasive component 12, with a tungsten carbide erosion layer 20 whose thickness is between 2 and 2.5 mm and which goes down to 0.7 mm in the vicinity of the point of the tool. This erosion layer covers the frustoconical surfaces 15*a* and 15*b* and the toric surface 15*c*.

This layer for protecting against erosion may be obtained as previously by deposition with a torch or by infiltration of binder into a layer of moulded tungsten carbide powder.

The advantage during operation of the tool for working potash are identical to the advantages mentioned above for the tool for working coal.

Figure 3:
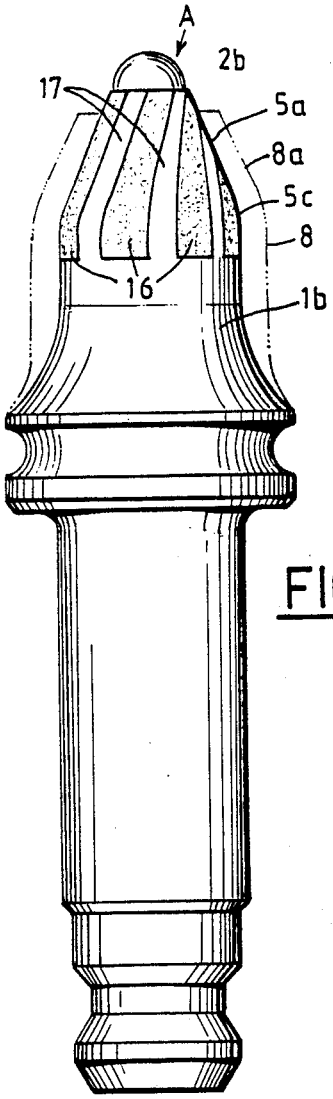
FIG. 3 is a view in elevation of a tool according to the invention and according to an alternative embodiment designed for working coal.
Figure 3A:
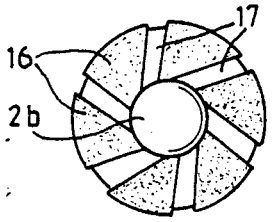
FIG. 3A is a plan view along A of FIG. 3.

FIGS. 3 and 3A show a tool for working coal which is identical to the tool shown in FIG. 1, with the exception of the production of the erosion layer on the working surface of the tool.

The corresponding elements in FIGS. 1, on the one hand, and 3 and 3A, on the other hand, have the same references. Only the references relating to the erosion layer have been modified.

The erosion layer of the working surface of the tool shown in FIGS. 3 and 3A consists of segments of tungsten carbide 16 brazed into shallow housings machined or stamped onto the surface of the body of the tool and arranged in succession according to the circumference of the working surface in its zones 5*a* and 5*c*.

A gap 17 where the surface of the body of the tool is not covered is provided between two successive erosion segments 16 and is simply protected by the erosion segments located on either side.

In order to avoid "inter-segment" erosion, the erosion segments have an overall halicoidal shape, the direction of winding of the helix corresponding to the counter-rotation direction of the tool during operation.

The abrasive point makes an incision in the rock which the front cone bursts open. Consequently, the working surface must be effectively protected against erosion, at least in the immediate vicinity of the abrasive component, in its conical part, with a slight projection on the cylindrical part 5*b*, that is to say covering the toric zone 5*c* and, optionally, the front end of the cylindrical part 5*b*. This avoids the risks of retro-abrasion of the part 1*b* of the body of the tool.

Figure 4:
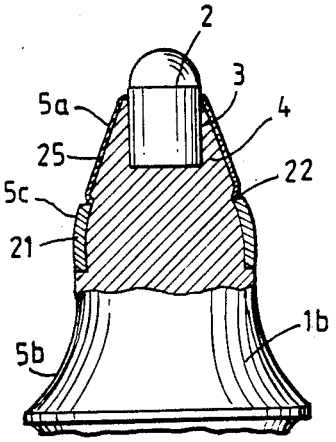
FIG. 4 is a sectional view of the working end of a tool for working coal according to the invention and according to a second alternative embodiment.
Figure 5:
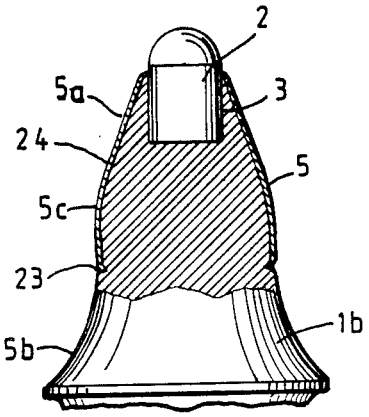
FIG. 5 is a sectional view of the working end of a tool for working coal according to the invention and according to a third alternative embodiment.

FIGS. 4 and 5 show a second and third alternative embodiment of the erosion layer of a tool for mine working coal, as shown in FIGS. 1, 3 and 3A.

The geometrical shape of the tools according to the embodiment of FIG. 1 and according to the three alternative embodiments is substantially identical.

The corresponding elements of the tools shown in FIG. 1, on the one hand, and in FIGS. 4 and 5, on the other hand, bear the same references, only the references relating to the erosion layer of the working surface of the tools have been modified.

In all cases, the diamond-charged composite abrasive component 2 is fixed directly into a housing 3 provided at the end of the working part 1*b* of the tool.

The alternative embodiment shown in FIG. 4 is characterized by a diamond erosion layer 25 electrodeposited on the frustoconical surface 5*a* of the component holder 4 and by a tungsten carbide layer 21 deposited with a torch on the part 1*b* of the steel body of the tool, on the toric surface 5*c* and on the end part of the surface 5*b*. The layer 21 could also consist of metal-infiltrated tungsten carbide.

The thickness of the electrodeposited diamond layer is 0.5 mm and the thickness of the tungsten carbide layer 21 is 2 mm. A groove 22 is provided in the body of the tool at the rear end of the layer 25.

The shallow groove 22 makes it possible to limit the zone covered by the electrodeposited diamond 20 and to avoid any detachment of the layer by means of retroabrasion.

The electrodeposited diamond layer 25 may be replaced by a silicon carbide layer, which is also electrodeposited, of the same thickness or a diamond and silicon carbide mixture.

FIG. 5 shows a third alternative embodiment of the tool, the erosion layer of the working surface 5 in this case consisting of a continuous electrodeposited diamond layer 24 ending inside a shallow groove 23 with a rounded edge. The electrodeposited diamond layer 24, whose thickness is 0.6 mm, covers the frustoconical part 5*a*, the toric part 5*c* and the cylindrical front part 5*b* of the working surface 5 of the tool.

Instead of an electrodeposited diamond layer, it would be possible to deposit a protective layer consisting of electrodeposited silicon carbide over a total thickness of less than 1 mm or a diamond and silicon carbide mixture.

In all cases, regardless of the rock being worked and regardless of the precise geometrical shape of the end of the tool, the thickness of the erosion layer protecting the working surface of the tool is chosen within the following ranges:

between 1 and 3 mm, in the case of a thermal deposition of carbide;

between 1 and 3 mm, in the case of a premoulded carbide layer infiltrated by a metallic binder;

approximately 2 mm, in the case of attached carbide segments or in the case of diamond-charged concretions, that is to say of diamond particles bonded by a metal or an alloy.

In the case of diamond-charged concretions or segments brazed onto the working surface, it is preferable to machine shallow housings with a shape corresponding to that of the segments or concretions which are attached and brazed inside the housing.

As indicated above, it is advantageous to provide segments of helicoidal shape and therefore housings of corresponding shape, depending on the direction of rotation of the tool. Advantageously, these housings will make an angle greater than 30° with the erosion lines of the tool.

In all cases, it has been possible to observe that the tools according to the invention have a resistance to wear and tear which is much greater than that of standard tools with a carbide tip, even in the case where these tools have a profile close to the equilibrium profile for the rock in question. The tools according to the invention also have a resistance to wear and tear which is much greater than that of tools with a diamond-charged tip housed in a carbide component.

The invention is not limited to the embodiments which have been described.

This makes it possible to envisage tools for working coal or potash which have a different shape from those which have been described and shown. In particular, this invention is applicable to fixed, so-called "front attack" tools: in fact, when the point of the tool consists of a composite abrasive component, the tool may remain fixed. The tool is no longer symmetrical in revolution with respect to an axis but is syummetrical with respect to a plane.

Similarly, it is possible to envisage tools for working other rocks, the working surface of which has a different shape and, in particular, a different angle at the vertex of the frustoconical surface of the component holder.

The angle at the vertex of the working surface of the component holder will preferably be approximately 30% less than the angle at the vertex of a conventional carbide tool used for working the same rock.

It is possible to envisage a slightly smaller reduction of this angle at the vertex; in order to obtain sufficient behaviour performance with respect to erosion, it is, however, necessary to reduce this angle by at least 20% with respect to the angles at the vertex of the corresponding parts of the standard tools.

The active part of teh diamond-charged abrasive component may have a shape which is different from the hemispherical shape and, for example, a frustoconical shape.

Quite obviously, in order to produce the body of the tool, it is possible to use any steel whose mechanical characteristics and, in particular, resilience are sufficient under the conditions of use.

The tools according to the invention may be used on any mine working machine and, in particular, on coal cutters and punctiform attack machines.

What is claimed is:

1. A tool for a mine working machine comprising:

a single piece steel component body comprising a rear part for enabling said rear part to be mounted into a tool support of the working machine and a front working part provided with a housing and limited by an external working surface of overall frustoconical shape surrounding the housing and corresponding substantially to an equilibrium erosion profile of the tool in its working conditions, the external working surfacing being at least partially covered with an erosion layer of a material whose hardness is greater than that of the steel forming the body; and a composite abrasive component directly fixed in the housing of the steel body, said composite abrasive component consisting of a metallic carbide slug integrally bonded to a polycrystal diamond active part having one end thereof projecting from the body.

2. The tool according to claim 1, wherein the angle at a vertex (a') of the working surface is substantially equal to 40°, and wherein the tool is for working coal.

3. The tool according to claim 1, wherein the angle at a vertex (a') of the working surface is substantially equal to 55°, and wherein the tool is for working potash.

4. The tool according to claim 1, wherein the erosion layer consists of tungsten carbide and a metallic binder deposited with a torch, and wherein the erosion layer has a thickness of between 1 and 3 mm.

5. The tool according to claim 1, wherein the erosion layer consists of tungsten carbide particles infiltrated by a liquid metal and the erosion layer has a thickness of between 1 and 3 mm.

6. The tool according to claim 1, wherein the erosion layer comprises segments of a hard material with a thickness of approximately 2 mm, said segments being fixed by brazing onto the body of the tool and being separated by spaces.

7. The tool according to claim 6, wherein the segments are made of tungsten carbide.

8. The tool according to claim 6, wherein the segments consist of diamond-charged concretions.

9. The tool according to claim 6, wherein the segments have an overall helicoidal shape.

10. The tool according to claim 7, wherein the segments have an overall helicoidal shape.

11. The tool according to claim 8, wherein the segments have an overall helicoidal shape.

12. The tool according to claim 1, wherein the erosion layer consists of an electrodeposited diamond layer having a thickness which is less than approximately 1 mm.

13. The tool according to claim 1, wherein the erosion layer includes one of an electrodeposited silicon carbide layer and a mixed diamond and silicon carbide layer, and wherein the erosion layer has a thickness which is less than approximately 1 mm.

14. The tool according to claim 12, further including a carbide layer, deposited with a torch, on a rear part of the working surface.

15. The tool according to claim 12, further including an infiltrated carbide layer is disposed at a rear part of the work surface and has a thickness of approximately 2 mm.

* * * * *